US009611616B2

(12) United States Patent
Takada et al.

(10) Patent No.: US 9,611,616 B2
(45) Date of Patent: Apr. 4, 2017

(54) BUCKET ATTACHING STRUCTURE OF CONSTRUCTION MACHINE AND CONSTRUCTION MACHINE

(71) Applicant: Shun Maruyama, Saitama (JP)

(72) Inventors: Yoshinori Takada, Yotsukaido (JP); Shun Maruyama, Saitama (JP); Mitsuru Maruyama, Tokyo (JP)

(73) Assignees: Shun Maruyama, Saitama (JP); Kabushiki Kaisha MYC, Tokyo (JP)

( * ) Notice: Subject to any disclaimer, the term of this patent is extended or adjusted under 35 U.S.C. 154(b) by 111 days.

(21) Appl. No.: 14/582,320

(22) Filed: Dec. 24, 2014

(65) Prior Publication Data

US 2016/0186405 A1 Jun. 30, 2016

(51) Int. Cl.
*E02F 3/36* (2006.01)

(52) U.S. Cl.
CPC ..... *E02F 3/3618* (2013.01); *E02F 3/365* (2013.01); *E02F 3/3622* (2013.01); *E02F 3/3627* (2013.01); *E02F 3/3668* (2013.01); *E02F 3/3672* (2013.01)

(58) Field of Classification Search
CPC ..... E02F 3/3604; E02F 3/3609; E02F 3/3618; E02F 3/3622; E02F 3/3627; E02F 3/3631; E02F 3/364; E02F 3/365; E02F 3/3654; E02F 3/3663; E02F 3/3668; E02F 3/3672; E02F 3/3686; E02F 3/96; E02F 3/962; Y10S 414/125
USPC ..... 37/403, 468; 414/723, 724
See application file for complete search history.

(56) References Cited

U.S. PATENT DOCUMENTS 5,324,162 A * 6/1994 Kishi ..... E02F 3/3618 37/468

FOREIGN PATENT DOCUMENTS

| | | | | |
|---|---|---|---|---|
| JP | 3677905 B2 * | 8/2005 | ..... | E02F 3/3622 |
| JP | 2006169886 A | 6/2006 | | |
| JP | 3134696 U | 8/2007 | | |
| JP | 2011231505 A | 11/2011 | | |

* cited by examiner

*Primary Examiner* — Michael McCullough
*Assistant Examiner* — Brendan Tighe
(74) *Attorney, Agent, or Firm* — Dinsmore & Shohl LLP

(57) ABSTRACT

A bucket attaching structure of a construction machine and a construction machine including a fixed jaw portion attached to a distal end portion of an operation arm and a movable jaw portion attached to a distal end portion of a piston through a bucket link. The fixed jaw portion and the movable jaw portion are each partially open and each include a semicircular arc-shaped engagement portion that corresponds to an outer peripheral surface of a corresponding bucket connecting pin. The bucket attaching structure of a construction machine and the construction machine include semicircular arc-shaped closure portions that each support the bucket connecting pins together with the semicircular arc-shaped engagement portions by, after engaging each semicircular arc-shaped engagement portion with the corresponding connecting pin, closing a partially open side of the corresponding semicircular arc-shaped engagement portion of the fixed jaw portion and that of the movable jaw portion.

5 Claims, 15 Drawing Sheets

BUCKET ATTACHING STRUCTURE OF CONSTRUCTION MACHINE AND CONSTRUCTION MACHINE

BACKGROUND OF THE INVENTION

1. Field of the Invention

The present disclosure relates to an attaching structure of a bucket of a construction machine, such as a power shovel, and a construction machine.

2. Description of the Related Art

Hitherto, as a bucket attaching structure of a construction machine, such as a power shovel, Japanese Unexamined Patent Application Publication No. 2011-231505, for example, proposes a structure in which, after two bucket connecting pins, which are provided at a rear portion of a bucket at a predetermined interval with respect to each other, are each engaged with a corresponding one of a partially-open fixed jaw portion and a partially-open movable jaw portion, the movable jaw portion is biased so as move away from the fixed jaw portion with a restriction member, a coil spring, and the like. Japanese Registered Utility Model No. 3134696, for example, proposes a structure in which a movable jaw portion is biased so as move away from a fixed jaw portion by driving a screw and the like, and, further, Japanese Unexamined Patent Application Publication No. 2006-169886, for example, proposes a structure in which a movable jaw portion is biased so as to move away from a fixed jaw portion with a dedicated hydraulic cylinder.

However, since the bucket attaching structures of a construction machine described in Japanese Unexamined Patent Application Publication No. 2011-231505, Japanese Registered Utility Model No. 3134696, and Japanese Unexamined Patent Application Publication No. 2006-169886 that are described above need to, after engaging the bucket connecting pins with the partially-open fixed jaw portion and the partially-open movable jaw portion, bias the movable jaw portion away from the fixed jaw portion with a restriction member and a coil spring, with a spring, or with a hydraulic cylinder and the like, cost disadvantageously increases accordingly.

Furthermore, although the movable jaw portion is biased away from the fixed jaw portion with a screw, a hydraulic cylinder, or the like, because a portion of the fixed jaw portion and a portion of the movable jaw portion with which the bucket connecting pins are engaged are kept open, there is a risk of the bucket connecting pins becoming dislocated from the fixed jaw portion and the movable jaw portion.

Accordingly, the present disclosure has been made in view of the above problems and an object thereof is to provide a bucket attaching structure of a construction machine and a construction machine that do not need any drive actuator, such as a screw or a hydraulic cylinder, for operating the movable jaw portion and that can reliably prevent the bucket connecting pins from becoming dislocated from the fixed jaw portion and the movable jaw portion.

SUMMARY OF THE INVENTION

In order to overcome the above problems, a bucket attaching structure of a construction machine according to an aspect of the present disclosure includes a fixed jaw portion that is attached to an distal end portion of an operation arm of the construction machine, the construction machine including a power shovel; and a movable jaw portion that is attached to a distal end portion of a piston through a bucket link, the piston being extended from and retracted into a bucket driving cylinder, in which a bucket is attached to the construction machine by engaging each of the fixed jaw portion and the movable jaw portion to a corresponding one of two bucket connecting pins, the bucket connecting pins being provided at a predetermined interval with respect to each other at a rear portion of the bucket, and the fixed jaw portion and the movable jaw portion each include a partially open, semicircular arc-shaped engagement portion having a semicircular arc-shaped cross-section corresponding to an outer peripheral surface of the bucket connecting pin, and a semicircular arc-shaped closure portion having a semicircular arc-shaped cross-section, the semicircular arc-shaped closure portion supporting one of the bucket connecting pins between the semicircular arc-shaped closure portion and the semicircular arc-shaped engagement portion by closing a partially open side of the semicircular arc-shaped engagement portion after the semicircular arc-shaped engagement portion is engaged with the one of the bucket connecting pins.

Note that, preferably, the movable jaw portion is provided in a slidable manner with respect to the fixed jaw portion, and after the semicircular arc-shaped engagement portion of the fixed jaw portion is engaged with a first bucket connecting pin, the movable jaw portion is slid with respect to the fixed jaw portion so that the semicircular arc-shaped engagement portion of the movable jaw portion is engaged with a second bucket connecting pin.

Furthermore, it is further preferable that the semicircular arc-shaped closure portion of the fixed jaw portion and the semicircular arc-shaped closure portion of the movable jaw portion are each a swinging semicircular arc-shaped closure portion that is provided in the fixed jaw portion or the movable jaw portion in a rotatable manner about a rotating shaft, after engaging each semicircular arc-shaped engagement portion to a corresponding bucket connecting pin, each swinging semicircular arc-shaped closure portion is swung about the corresponding rotating shaft so as to close the partially open side of the corresponding semicircular arc-shaped engagement portion that opposes the relative swinging semicircular arc-shaped closure portion with the corresponding rotating shaft in between to support the corresponding bucket connecting pin, and a supported state of each bucket connecting pin is locked by a lock pin after the corresponding swinging semicircular arc-shaped closure portion is pivoted to support the corresponding bucket connecting pin.

Furthermore, it is further preferable that each swinging semicircular arc-shaped closure portion includes a first swinging semicircular arc-shaped closure piece and a second swinging semicircular arc-shaped closure piece that are connected to each other in swingably by a turning pin, a base end side of each first swinging semicircular arc-shaped closure piece is coupled to a distal end side of the corresponding second swinging semicircular arc-shaped closure piece in swingably by a turning pin and a distal end side of each first swinging semicircular arc-shaped closure piece includes a semicircular arc-shaped abutting portion that corresponds to an outer peripheral surface of the corresponding bucket connecting pin, the semicircular arc-shaped abutting portion and the semicircular arc-shaped engagement portion of the movable jaw portion or the fixed jaw portion hold and support the bucket connecting pin therebetween, and the distal end side of each second swinging semicircular arc-shaped closure piece is coupled to the base end side of the corresponding first swinging semicircular arc-shaped closure piece in swingably by a turning pin and a base end side of each second swinging semicircular arc-shaped closure piece is attached to the movable jaw portion or the fixed jaw portion in swingably by a pivot shaft, and when the semicircular arc-shaped abutting portion of each first swinging semicircular arc-shaped closure piece and the corresponding semicircular arc-shaped engagement portion of the movable jaw portion or the fixed jaw portion hold and support the bucket connecting pin therebetween, an inner surface of each second swinging semicircular arc-shaped closure piece between the corresponding turning pin and the corresponding pivot shaft abuts against the outer peripheral surface of the corresponding semicircular arc-shaped engagement portion.

Furthermore, preferably, the semicircular arc-shaped closure portion of the fixed jaw portion and the semicircular arc-shaped closure portion of the movable jaw portion are each a revolving semicircular arc-shaped closure portion that is revolvable along an outer periphery of the corresponding bucket connecting pin of the bucket, each support the bucket connecting pin by, after the semicircular arc-shaped engagement portion of the fixed jaw portion and the semicircular arc-shaped engagement portion of the movable jaw portion are each engaged with the corresponding bucket connecting pin, revolving each revolving semicircular arc-shaped closure portion along the outer periphery of the corresponding bucket connection pin so as to close the partially open side of the corresponding semicircular arc-shaped engagement portion, and a supported state of a bucket connecting pin is locked by a lock pin after the revolving semicircular arc-shaped closure portion is slid to support the bucket connecting pin.

Furthermore, a construction machine according to another aspect of the present exemplary embodiment includes the bucket attaching structure of a construction machine described above.

In the bucket attaching structure of a construction machine and the construction machine according to the aspects of the present disclosure, a drive actuator, such as a screw or a hydraulic cylinder, for operating the movable jaw portion will not be required resulting in a reduction of cost and, further, dislocation of the bucket connecting pins from the fixed jaw portion and the movable jaw portion can be prevented in a reliable manner.

BRIEF DESCRIPTION OF THE DRAWINGS

FIG. 10 is a cross-sectional view illustrating a bucket attaching structure in which the revolving semicircular arc-shaped closure portions are in a retracted state;

FIG. 11 is a cross-sectional view illustrating a state after the bucket connecting pins are supported by the revolving semicircular arc-shaped closure portions;

DESCRIPTION OF THE PREFERRED EMBODIMENTS

Hereinafter, construction machines and bucket attaching structures (apparatuses or mechanisms) 1 of a construction machine according to the exemplary embodiments of the present disclosure will be described in detail with reference to the drawings.

Configuration of Bucket Attaching Structure 1 of Construction Machine

Figure 1:
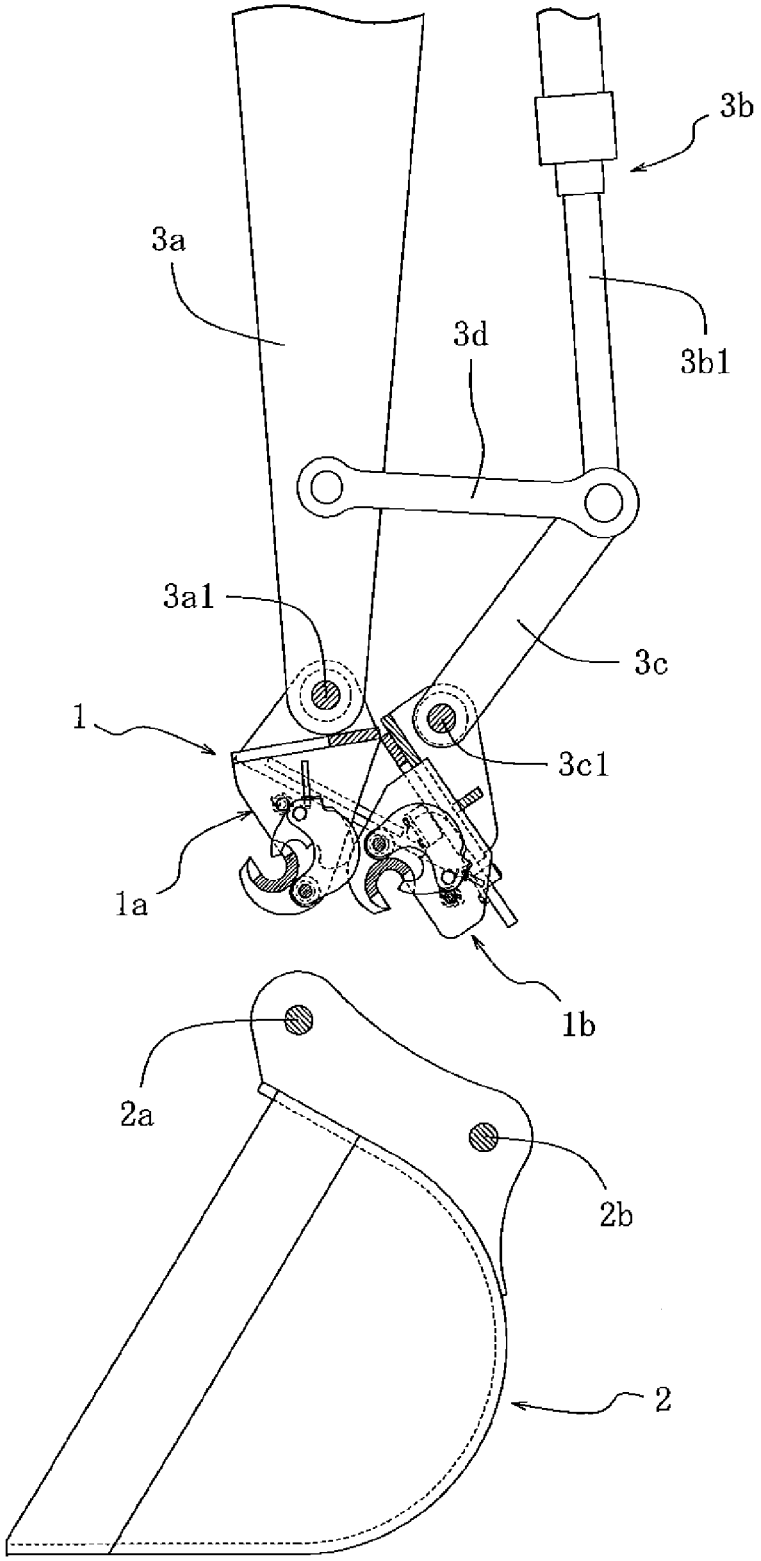
FIG. 1 is a front view illustrating a state when a bucket is attached to an operation arm through a bucket attaching structure of a construction machine according to an exemplary embodiment of the present disclosure.
Figure 2:
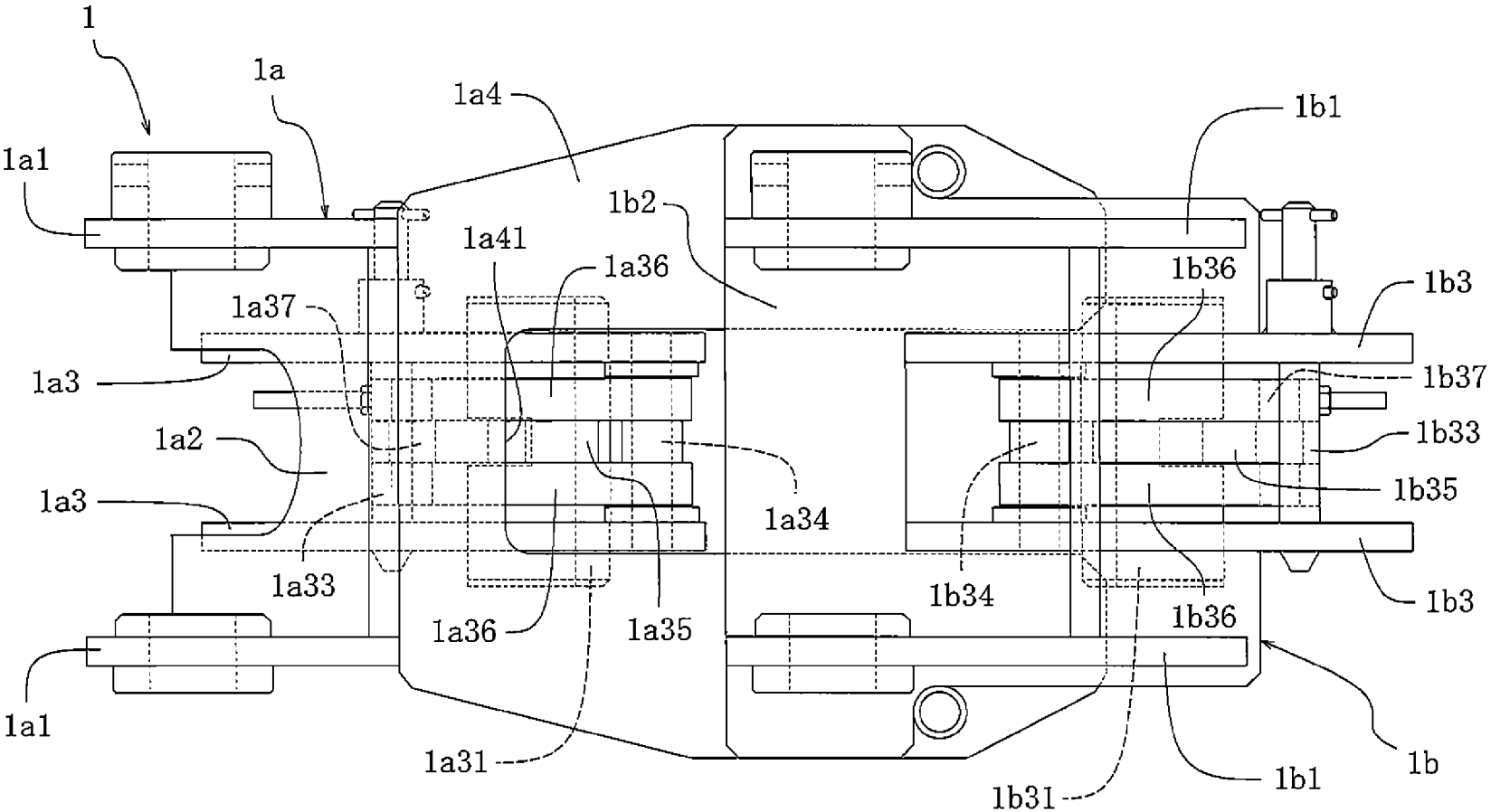
FIG. 2 is a plan view of the bucket attaching structure of the construction machine according to the exemplary embodiment of the present disclosure.
Figure 3:
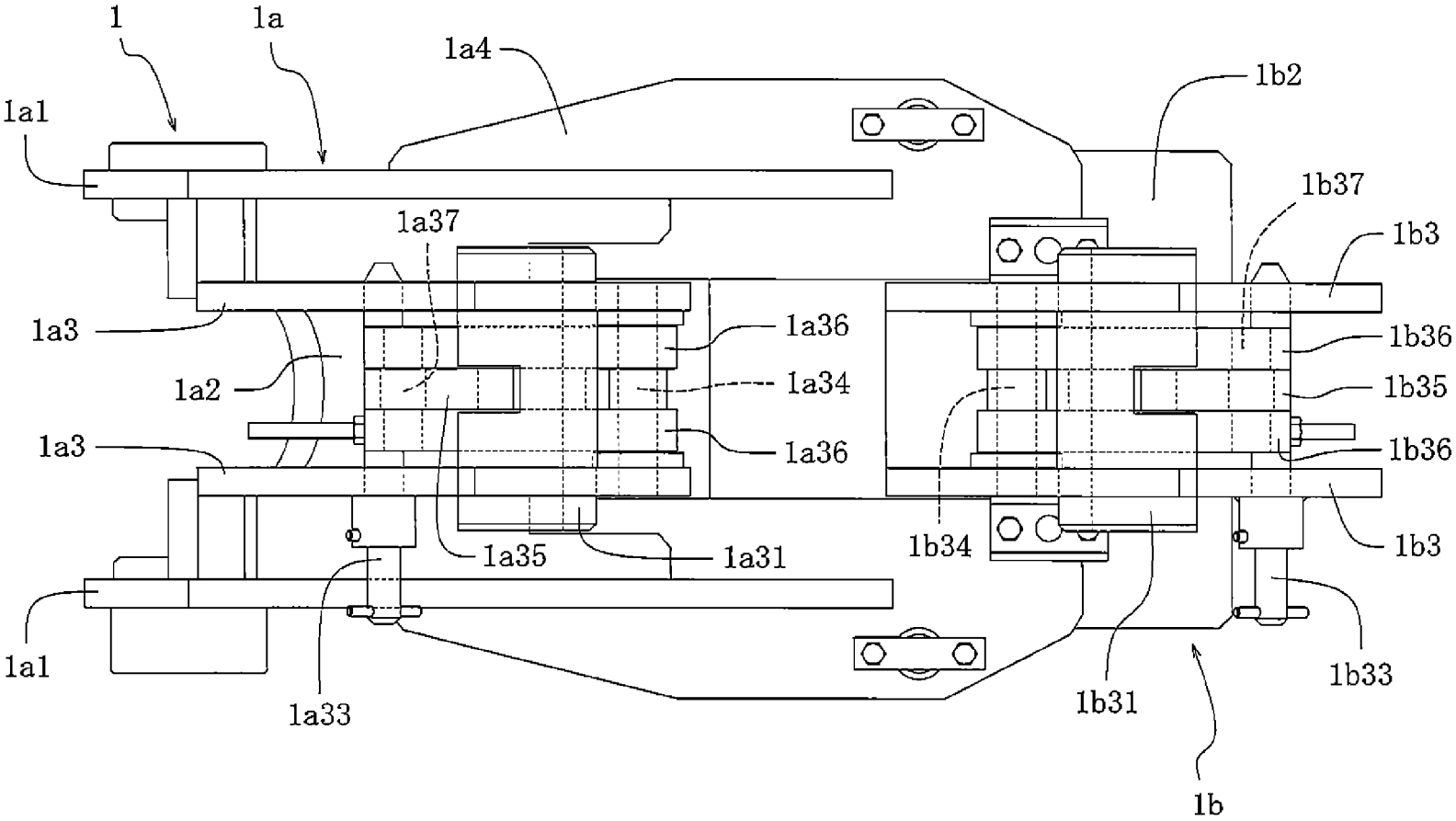
FIG. 3 is a bottom view of the bucket attaching structure of the construction machine according to the exemplary embodiment of the present disclosure.

As illustrated in FIG. 1, a bucket attaching structure 1 of a construction machine according to the exemplary embodiment of the present disclosure attaches a bucket 2 thereto by engaging two bucket connecting pins 2*a* and 2*b*, which are provided at a predetermined interval with respect to each other at a rear portion of the bucket 2, with a fixed jaw portion 1*a* that is attached to a distal end portion of an operation arm 3*a* of a construction machine (not shown), such as a power shovel, and a movable jaw portion 1*b* that is attached to a distal end portion of a piston 3*b*1, which is extended from and retracted into a bucket driving cylinder 3*b*, through a bucket link 3*c*, respectively. Note that in FIG. 1, reference numeral 3*d* denotes an arm link, a base end portion of which is connected to the operation arm 3*a* in a pivotal manner while a distal end portion thereof is connected, in a pivotal manner, to the distal end portion of the piston 3*b*1, which is extended from and retracted into the bucket driving cylinder 3*b*, and to a base end portion of the bucket link 3*c*. Note that, other than the bucket attaching structure 1, components, such as the bucket 2, the operation arm 3*a*, the bucket driving cylinder 3*b*, the bucket link 3*c*, and the arm links 3*d*, and the connection structure of the above components are the same as those of conventional construction machines, and the components and the connection structure are known components and is a known connection structure.

As illustrated in FIGS. 1 to 8, the bucket attaching structure 1 according to the exemplary embodiment of the present disclosure includes the fixed jaw portion 1*a* and the movable jaw portion 1*b*.

Figure 4:
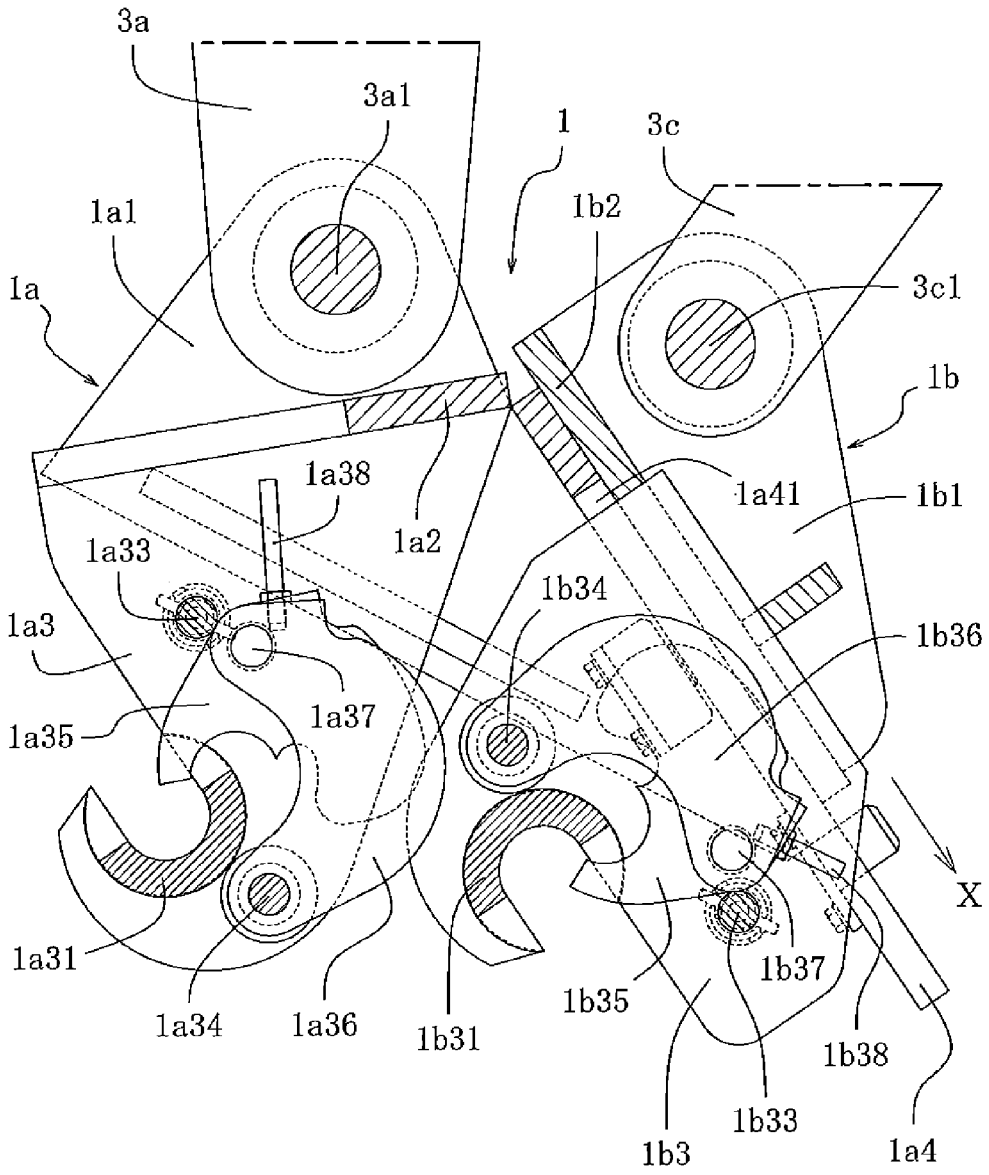
FIG. 4 is a cross-sectional view of the bucket attaching structure of the construction machine according to the exemplary embodiment of the present disclosure.

In the fixed jaw portion 1*a*, as illustrated in FIG. 4, fixed-side connection plates 1*a*1 are connected to the distal end portion of the operation arm 3*a* of the construction machine in swingably by a fixed jaw connecting pin 3*a*1, and fixed-side hook plates 1*a*3 are attached to lower end portions of the fixed-side connection plates 1*a*1 through a first fixing base plate 1*a*2.

The fixed-side hook plates 1*a*3 each include a semicircular arc-shaped engagement portion 1*a*31 that engages with the bucket connecting pin 2*a*, the semicircular arc-shaped engagement portion 1*a*31 being partially open and having a substantially semicircular arc-shaped cross-section corresponding to an outer peripheral surface of the bucket connecting pin 2*a*; a lock pin insertion/extraction hole 1*a*32 into which an inserting/extracting lock pin 1*a*33 is inserted; a first swinging semicircular arc-shaped closure piece 1*a*35 and a second swinging semicircular arc-shaped closure piece 1*a*36 that are included in a double swinging semicircular arc-shaped closure portion that is connected with a turning pin 1*a*37 in a pivotal manner and that supports the bucket connecting pin 2*a* by pivoting about a pivot shaft 1*a*34; and a handle 1*a*38.

Figure 8:
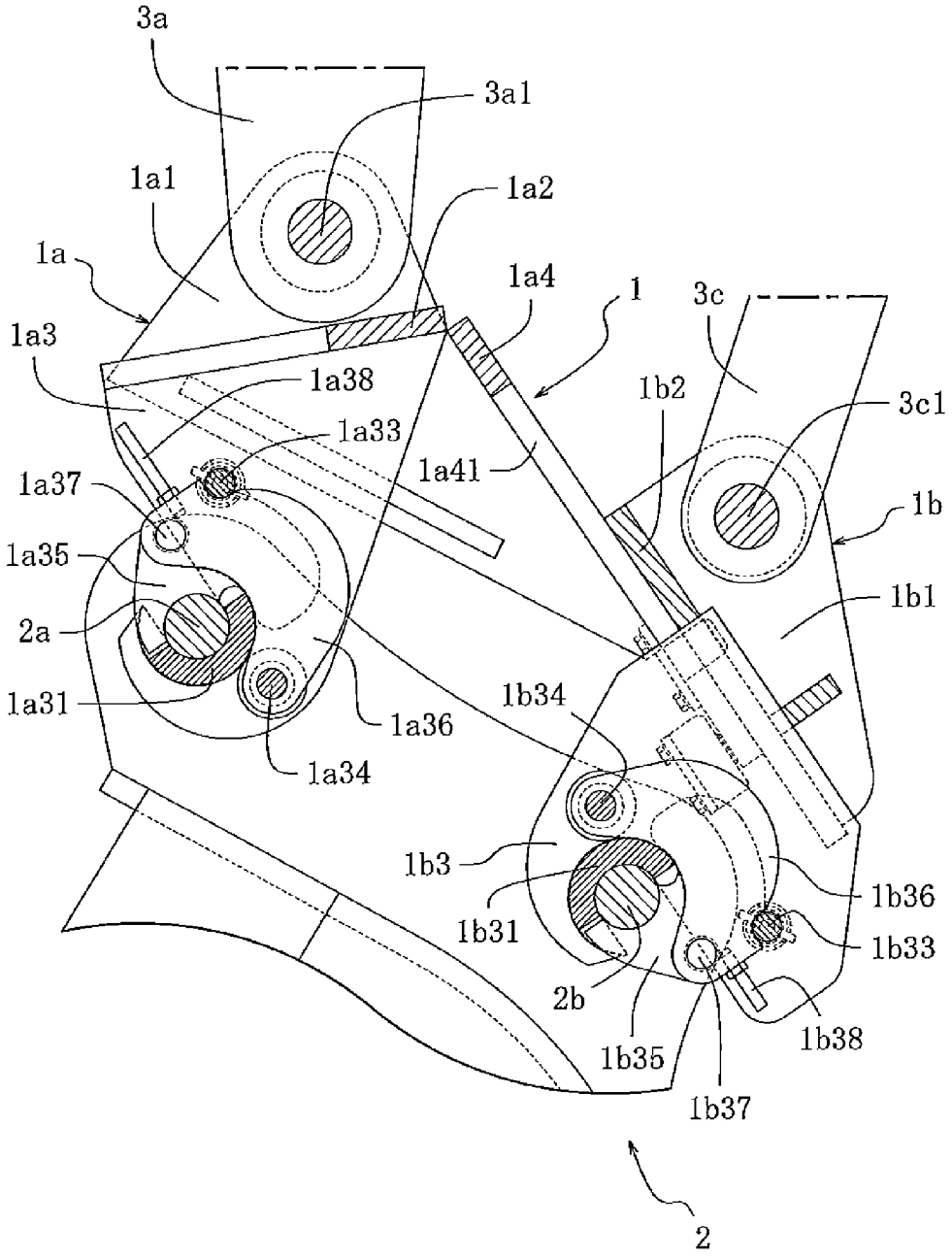
FIG. 8 is a cross-sectional view illustrating a state in which the bucket attaching structure of the construction machine according to the exemplary embodiment of the present disclosure is in operation (a state after the insertion of lock pins in which swinging semicircular arc-shaped closure portions support the bucket connecting pins)
Figure 9:
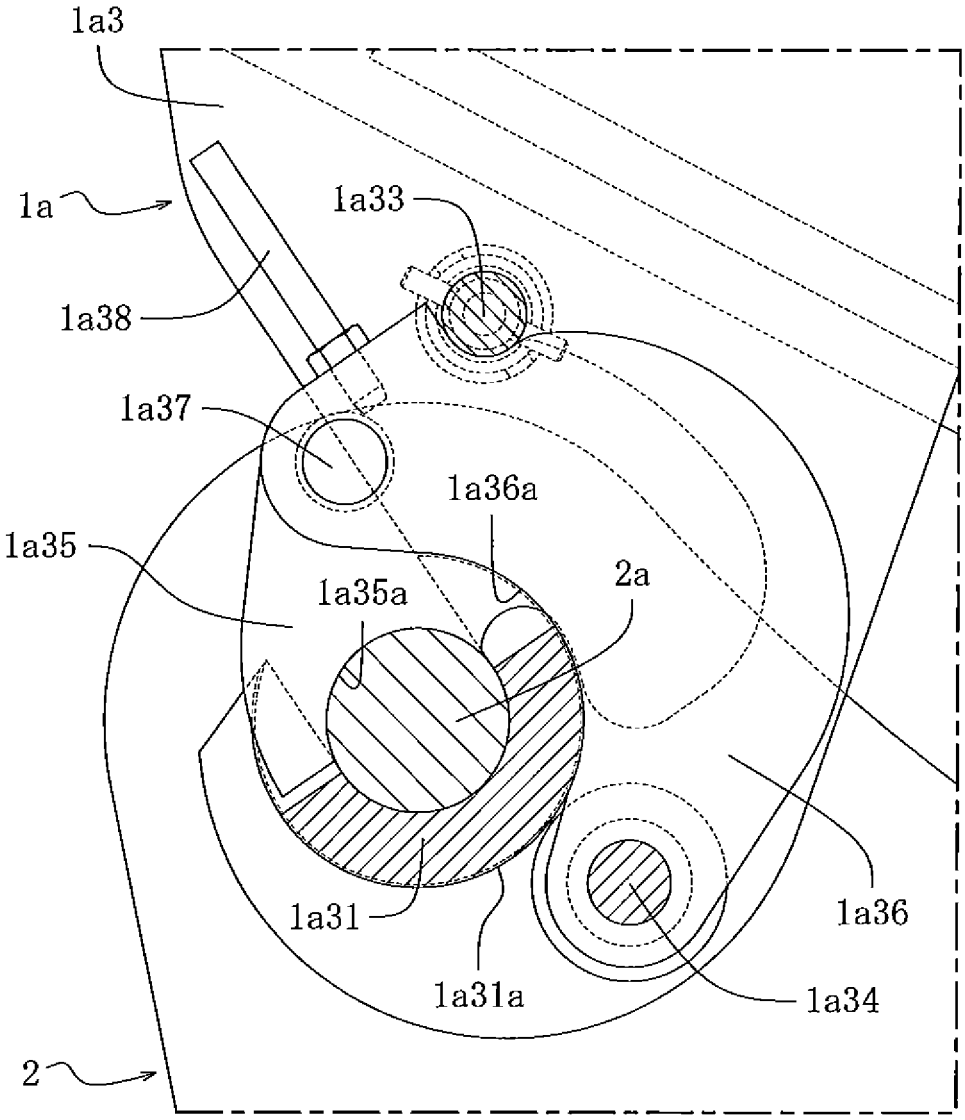
FIG. 9 is a cross-sectional view illustrating, in detail, a state in which the bucket connecting pin is supported by the swinging semicircular arc-shaped closure portion.

In other words, as illustrated in FIGS. 8 and 9, in the first swinging semicircular arc-shaped closure piece 1*a*35, a base end side is connected to a distal end side of the second swinging semicircular arc-shaped closure piece 1*a*36 in swingably by the turning pin 1*a*37, and a distal end side includes a semicircular arc-shaped abutting portion 1*a*35*a* that corresponds to the outer peripheral surface of the bucket connecting pin 2*a*. The semicircular arc-shaped abutting portion 1*a*35*a* and the semicircular arc-shaped engagement portion 1*a*31 of the fixed jaw portion 1*a* hold and support the bucket connecting pin 2*a* therebetween.

As illustrated in FIGS. 8 and 9, in the second swinging semicircular arc-shaped closure piece 1*a*36, the distal end side is connected to the base end side of the first swinging semicircular arc-shaped closure piece 1*a*35 in swingably by the turning pin 1*a*37, and the base end side is attached to the fixed jaw portion 1*a* in swingably by the pivot shaft 1*a*34. Furthermore, when the inserting/extracting lock pin 1*a*33 is inserted into the lock pin insertion/extraction hole 1*a*32 and when the semicircular arc-shaped abutting portion 1*a*35*a* of the first swinging semicircular arc-shaped closure piece 1*a*35 and the semicircular arc-shaped engagement portion 1*a*31 of the fixed jaw portion 1*a* hold and support the bucket connecting pin 2*a* therebetween, as illustrated in FIG. 9, an inner surface 1*a*36*a* of the second swinging semicircular arc-shaped closure piece 1*a*36 between the turning pin 1*a*37 and the pivot shaft 1*a*34 abuts against an outer peripheral surface 1*a*31*a* of the semicircular arc-shaped engagement portion 1*a*31 and receives, through the semicircular arc-shaped engagement portion 1*a*31, force applied to the bucket connecting pin 2*a*. Note that when the bucket connecting pin 2*a* is held between and supported by the semicircular arc-shaped abutting portion 1*a*35*a* and the semicircular arc-shaped engagement portion 1*a*31, two end portions of the first swinging semicircular arc-shaped closure piece 1*a*35 and two end portions of the semicircular arc-shaped engagement portion 1*a*31 of the fixed jaw portion 1*a* may either be in contact with each other or not in contact with each other; however, in the present exemplary embodiment, as illustrated in FIGS. 8 and 9 described later, the two end portions of the first swinging semicircular arc-shaped closure piece 1*a*35 and the two end portions of the semicircular arc-shaped engagement portion 1*a*31 of the fixed jaw portion 1*a* are not in contact with each other such that inner peripheral surfaces between each of the two end portions reliably hold the bucket connecting pin 2*a* from two sides in a close contact state with the bucket connecting pin 2*a*.

Furthermore, a second fixing base plate 1*a*4 is joined to the first fixing base plate 1*a*2 at a predetermined angle by welding or the like, and a sliding guide hole 1*a*41 for sliding the movable jaw portion 1*b* along the second fixing base plate 1*a*4 in the X direction of FIG. 4 is formed in the second fixing base plate 1*a*4.

As illustrated in FIG. 1, the movable jaw portion 1*b* is attached to the distal end portion of the piston 3*b*1, which is extended from and retracted into the bucket driving cylinder 3*b*, through a bucket link 3*c* and is provided in a slidable manner with respect to the fixed jaw portion 1*a*. Specifically, regarding the movable jaw portion 1*b*, as illustrated in FIG. 4, movable-side connection portions 1*b*1 are connected to a distal end portion of the bucket link 3*c* in swingably by a bucket connecting pin 3*c*1, and movable-side hook plates 1*b*3 are attached to lower end portions of the movable-side connection portions 1*b*1 through a sliding base plate 1*b*2.

The movable-side hook plates 1*b*3 each include a semicircular arc-shaped engagement portion 1*b*31 that engages with the bucket connecting pin 2*b*, a lock pin insertion/extraction hole 1*b*32 into which a lock pin 1*b*33 is inserted, a first swinging semicircular arc-shaped closure piece 1*b*35 and a second swinging semicircular arc-shaped closure piece 1*b*36 that are included in a double swinging semicircular arc-shaped closure portion that is connected with a turning pin 1*b*37 in a pivotal manner and that locks the bucket connecting pin 2*b* by pivoting about a pivot shaft 1*b*34, and a handle 1*b*38. Note that the first swinging semicircular arc-shaped closure piece 1*b*35 and the second swinging semicircular arc-shaped closure piece 1*b*36 on the movable-side hook plates 1*b*3 side are configured in the same manner as the first swinging semicircular arc-shaped closure piece 1*a*35 and the second swinging semicircular arc-shaped closure piece 1a36 on the fixed-side hook plates 1a3 side illustrated in FIG. 9 such that when the semicircular arc-shaped abutting portion of the first swinging semicircular arc-shaped closure piece 1b35 and the semicircular arc-shaped engagement portion 1b31 of the movable jaw portion 1b hold and support the bucket connecting pin 2b therebetween, an inner surface of the second swinging semicircular arc-shaped closure piece 1b36 between the turning pin 1b37 and the pivot shaft 1b34 abuts against an outer peripheral surface of the semicircular arc-shaped engagement portion 1b31 and receives, through the semicircular arc-shaped engagement portion 1b31, force applied to the bucket connecting pin 2b.

Method of Attaching Bucket 2 Using Bucket Attaching Structure 1 of Construction Machine A method of attaching the bucket 2 using the bucket attaching structure 1 of the construction machine according to the present exemplary embodiment will be described next.

First, an operator drives an arm cylinder and the like (not shown) of the construction machine to operate the operation arm 3a and engages the fixed-side hook plates 1a3 of the fixed jaw portion 1a to the bucket connecting pin 2a on one side of the rear end portion of the bucket 2. Note that in the above state, the piston 3b1 (see FIG. 1) of the bucket driving cylinder 3b is retracted and, as illustrated in FIG. 4, the portion between the semicircular arc-shaped engagement portion 1a31 of the fixed-side hook plates 1a3 and the semicircular arc-shaped engagement portion 1b31 of the movable-side hook plates 1b3 is narrower than the portion between the bucket connecting pins 2a and 2b at the rear portion of the bucket 2.

Figure 5:
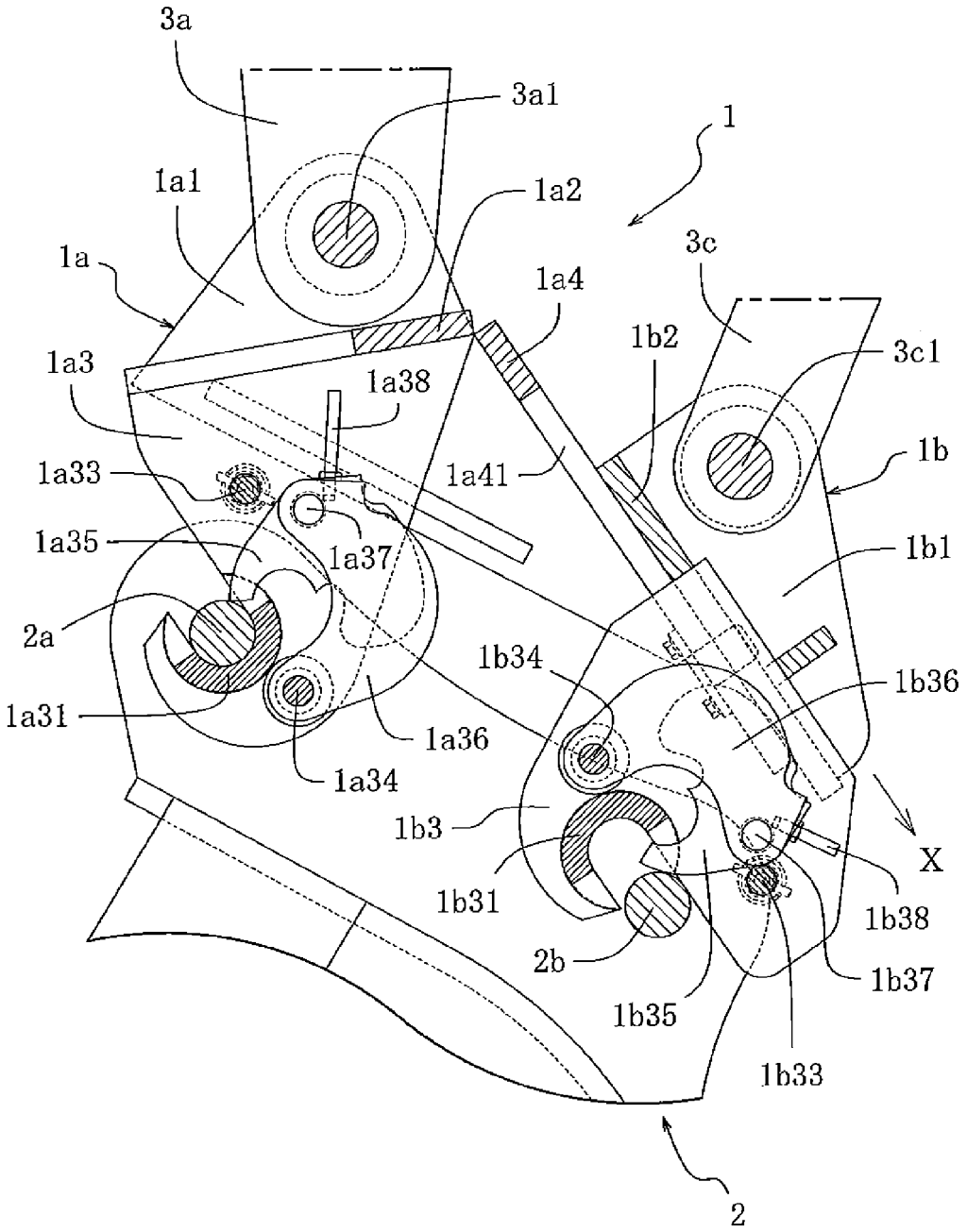
FIG. 5 is a cross-sectional view illustrating a state in which the bucket attaching structure of the construction machine according to the exemplary embodiment of the present disclosure is in operation (a state in which a fixed jaw portion only is engaged with bucket connecting pins)

Subsequently, the operator drives the bucket driving cylinder 3b of the construction machine to extend the piston 3b1 and, as illustrated in FIG. 5, slides the movable jaw portion 1b along the sliding guide hole 1a41 of the second fixing base plate 1a4 so as to slide the movable jaw portion 1b along the second fixing base plate 1a4 in the X direction such that the semicircular arc-shaped engagement portion 1b31 of the movable-side hook plates 1b3 moves towards the bucket connecting pin 2b at the rear portion of the bucket 2.

Figure 6:
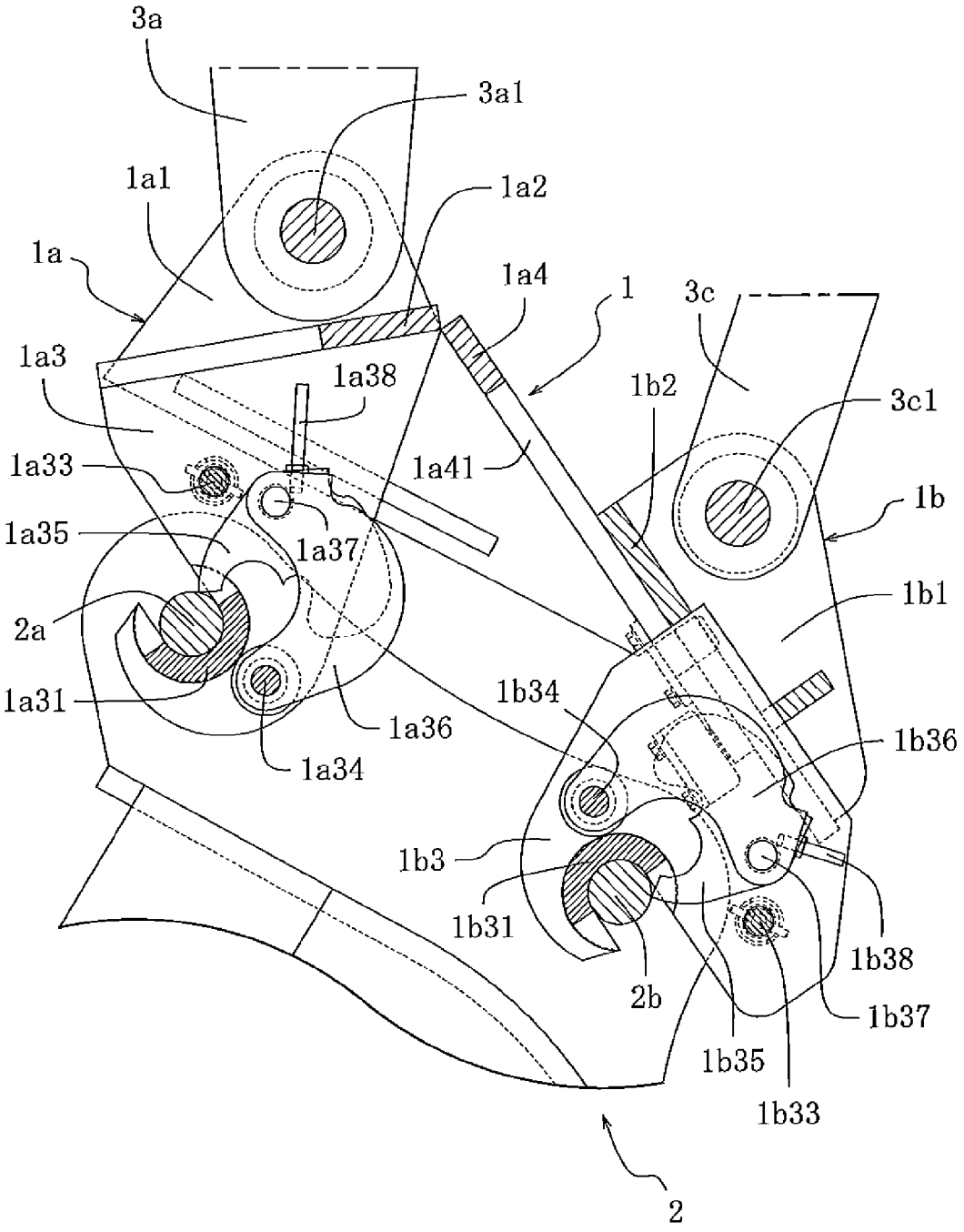
FIG. 6 is a cross-sectional view illustrating a state in which the bucket attaching structure of a construction machine according to the exemplary embodiment of the present disclosure is in operation (a state in which the fixed jaw portion and a movable jaw portion are engaged with the bucket connecting pins)

Then, as illustrated in FIG. 6, when the semicircular arc-shaped engagement portion 1b31 of the movable-side hook plates 1b3 comes in contact with the bucket connecting pin 2b at the rear portion of the bucket 2 and when the semicircular arc-shaped engagement portion 1a31 and the semicircular arc-shaped engagement portion 1b31 are engaged with the bucket connecting pins 2a and 2b, respectively, at the rear portion of the bucket 2, the operator pulls out the inserting/extracting lock pins 1a33 and 1b33 from the lock pin insertion/extraction hole 1a32 of the fixed-side hook plates 1a3 and the lock pin insertion/extraction hole 1b32 of the movable-side hook plates 1b3, respectively.

Figure 7:
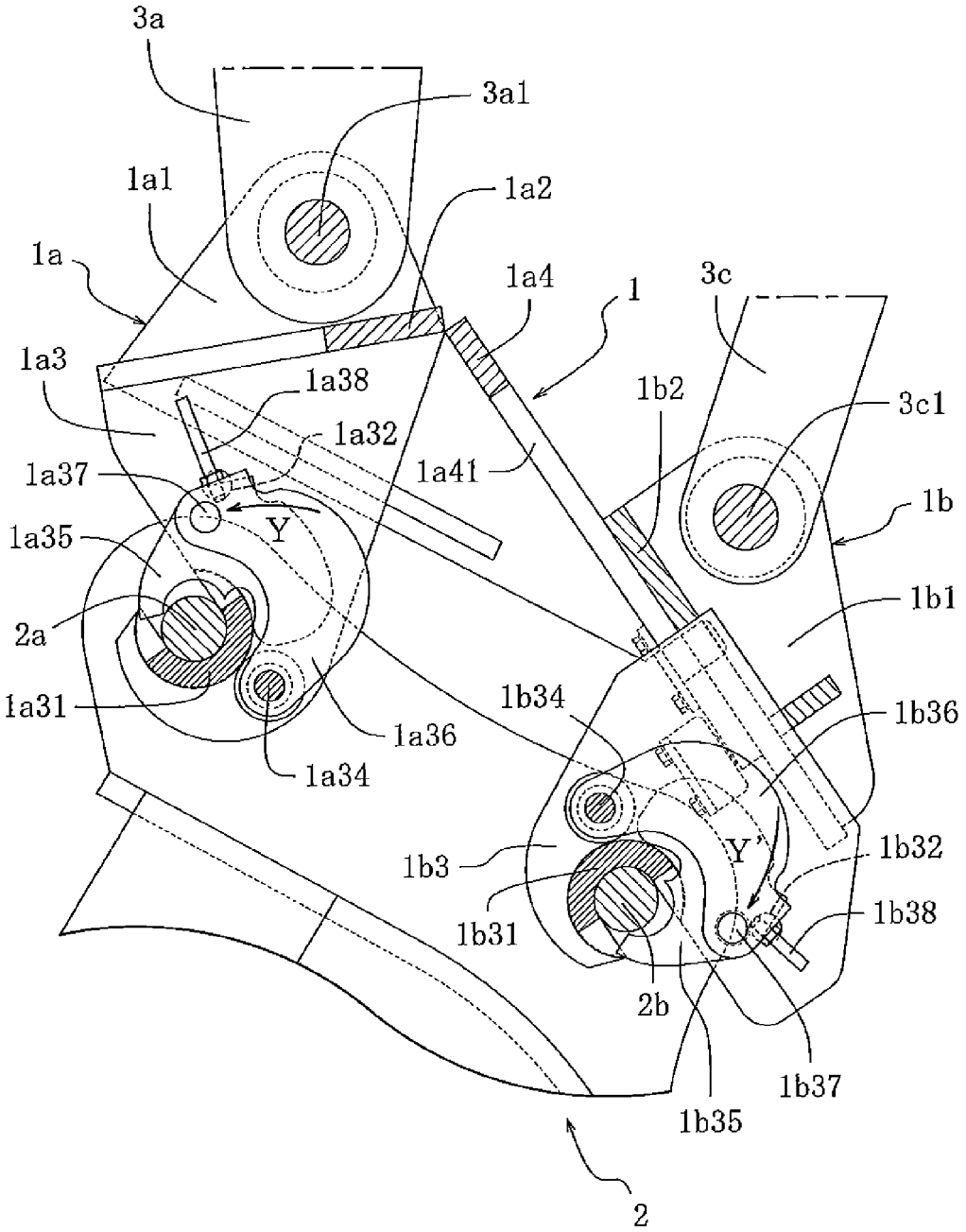
FIG. 7 is a cross-sectional view illustrating a state in which the bucket attaching structure of the construction machine according to the exemplary embodiment of the present disclosure is in operation (a state before the insertion of lock pins in which swinging semicircular arc-shaped closure portions support the bucket connecting pins)

Then, as illustrated in FIG. 7, the operator turns the handle 1a38 of the fixed jaw portion 1a in the Y direction (counterclockwise in FIG. 8) and, further, turns the handle 1b38 of the movable jaw portion 1b in the Y' direction (clockwise in FIG. 8) so as to pivot the first swinging semicircular arc-shaped closure pieces 1a35 and 1b35 and the second swinging semicircular arc-shaped closure pieces 1a36 and 1b36, which are included in the double swinging semicircular arc-shaped closure portions, about the pivot shafts 1a34 and 1b34 such that the open portion sides of the semicircular arc-shaped engagement portion 1a31 and the semicircular arc-shaped engagement portion 1b31 are closed.

Finally, as illustrated in FIG. 8, the operator inserts the inserting/extracting lock pins 1a33 and 1b33 into the lock pin insertion/extraction holes 1a32 and 1b32, respectively, of the fixed-side hook plates 1a3 and the movable-side hook plates 1b3, respectively, so as to lock the pivoting of the first swinging semicircular arc-shaped closure pieces 1a35 and 1b35 and the second swinging semicircular arc-shaped closure pieces 1a36 and 1b36 that are included in the double swinging semicircular arc-shaped closure portions such that a state in which the first swinging semicircular arc-shaped closure pieces 1a35 and 1b35 and the second swinging semicircular arc-shaped closure pieces 1a36 and 1b36 that are included in the double swinging semicircular arc-shaped closure portions supporting the bucket connecting pins 2a and 2b is secured.

As described above, in the bucket attaching structure 1 of the construction machine of the present exemplary embodiment, the movable jaw portion 1b is provided in a slidable manner with respect to the fixed jaw portion 1a, and, after the fixed jaw portion 1a is engaged with the bucket connecting pin 2a on one side, the movable jaw portion 1b is, with the bucket driving cylinder 3b, slid with respect to the fixed jaw portion 1a and is engaged with the other bucket connecting pin 2b on the other side and, then, the first swinging semicircular arc-shaped closure pieces 1a35 and 1b35 and the second swinging semicircular arc-shaped closure pieces 1a36 and 1b36 that are included in the double swinging semicircular arc-shaped closure portions are each pivoted about the corresponding one of the pivot shafts 1a34 and 1b34 so as to hold and support the corresponding one of the bucket connecting pins 2a and 2b between the semicircular arc-shaped engagement portions 1a31 and 1b31 of the fixed jaw portion 1a and the movable jaw portion 1b, and the first swinging semicircular arc-shaped closure pieces 1a35 and 1b35 that are included in the double swinging semicircular arc-shaped closure portions; accordingly, a drive actuator such as a screw or a hydraulic cylinder for operating the movable jaw portion 1b will not be required resulting in a reduction of cost and, further, dislocation of the bucket connecting pins 2a and 2b from the fixed jaw portion 1a and the movable jaw portion 1b can be prevented in a reliable manner.

In particular, in the bucket attaching structure 1 of the construction machine of the present exemplary embodiment, when the semicircular arc-shaped abutting portions 1a35a of the first swinging semicircular arc-shaped closure pieces 1a35 and the semicircular arc-shaped engagement portion 1a31 of the fixed jaw portion 1a hold and support the bucket connecting pin 2a therebetween, as illustrated in FIG. 9, the inner surfaces 1a36a of the second swinging semicircular arc-shaped closure pieces 1a36 between the turning pin 1a37 and the pivot shaft 1a34 abut against an outer peripheral surface 1a31a of the semicircular arc-shaped engagement portion 1a31 and receives, through the semicircular arc-shaped engagement portion 1a31, force applied to the bucket connecting pin 2a; accordingly, force that is applied to the bucket connecting pins 2a and 2b can be received by all of the first swinging semicircular arc-shaped closure pieces 1a35 and 1b35 and the second swinging semicircular arc-shaped closure pieces 1a36 and 1b36 and, thus, dislocation of the bucket connecting pins 2a and 2b from the fixed jaw portion 1a and the movable jaw portion 1b can be prevented in a further reliable manner.

Note that in the description of the above exemplary embodiment, it is described that the second fixing base plate 1a4 of the fixed jaw portion 1a is provided with the sliding guide hole 1a41 so as to slide the movable jaw portion 1b along the sliding guide hole 1*a*41 and engage the movable jaw portion 1*b* with the bucket connecting pin 2*b*; however, the present disclosure is not limited to the above and other than the above, a link mechanism, a rotation mechanism, a socket-and-spigot joint, a rail, or the like may be used as long as the movable jaw portion 1*b* can be slid with respect to the fixed jaw portion 1*a* by, for example, being parallely displaced or rotationally transferred and is engaged with the bucket connecting pin 2*b*.

Note that in the description of the above exemplary embodiment, it is described that after attaching the bucket 2, the first swinging semicircular arc-shaped closure pieces 1*a*35 and 1*b*35 and the second swinging semicircular arc-shaped closure pieces 1*a*36 and 1*b*36 that are included in the double swinging semicircular arc-shaped closure portions and that are respectively attached to the fixed jaw portion 1*a* and the movable jaw portion 1*b* about the pivot shafts 1*a*34 and 1*b*34, respectively, are pivoted and, then, the supported state of the bucket connecting pins 2*a* and 2*b* is secured by inserting the inserting/extracting lock pins 1*a*33 and 1*b*33 into the lock pin insertion/extraction holes 1*a*32 and 1*b*32, respectively; however, the present disclosure is not limited to the above and as illustrated in FIGS. 10 to 13, revolving semicircular arc-shaped closure portions 1*a*39 and 1*b*39 that revolve along the outer peripheries of the bucket connecting pins 2*a* and 2*b*, respectively, of the bucket 2 may be provided in the semicircular arc-shaped engagement portion 1*a*31 and the semicircular arc-shaped engagement portion 1*b*31, respectively.

Figure 10:
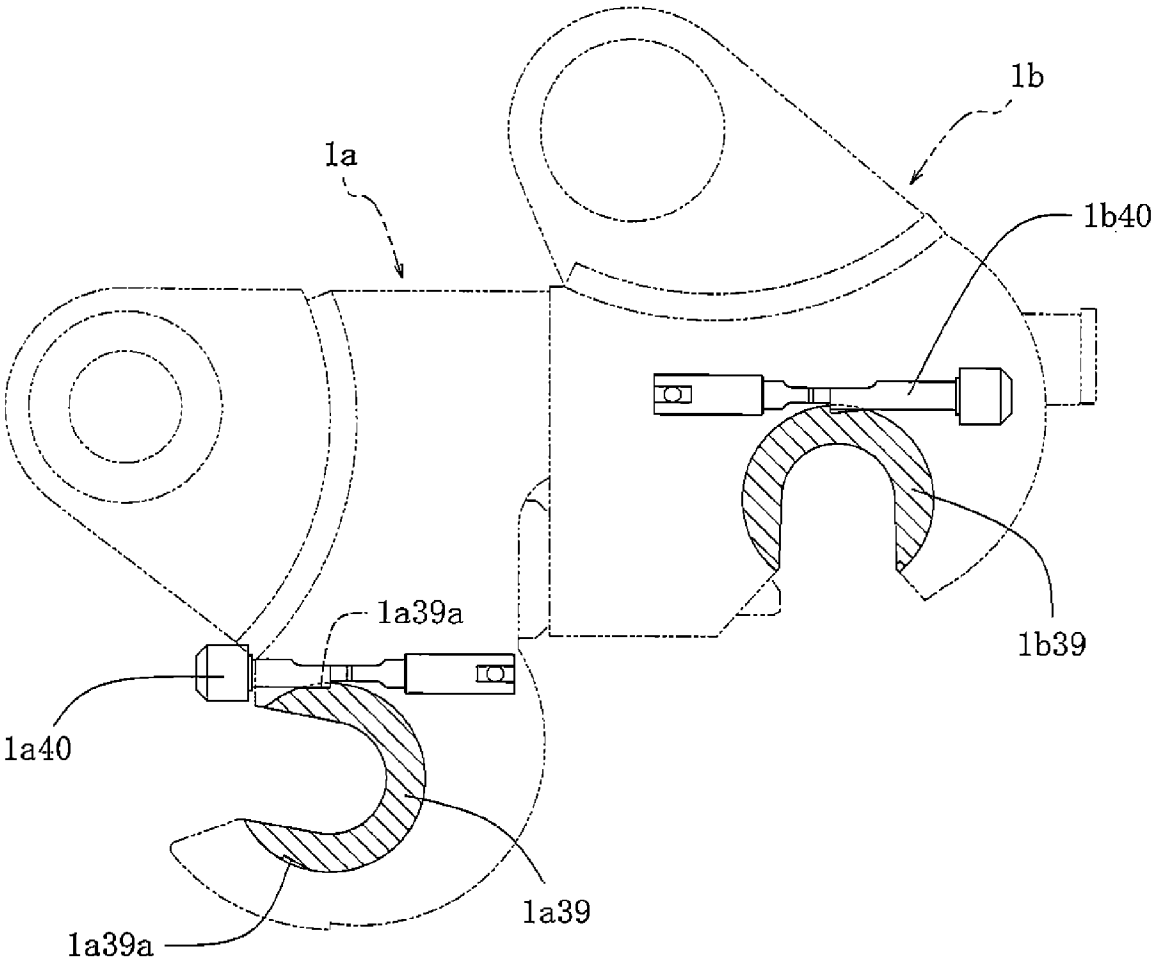
FIG. 10 is a cross-sectional view illustrating a bucket attaching structure of a construction machine in which, in place of double swinging semicircular arc-shaped closure portions, revolving semicircular arc-shaped closure portions and the like are used, that is.
Figure 11:
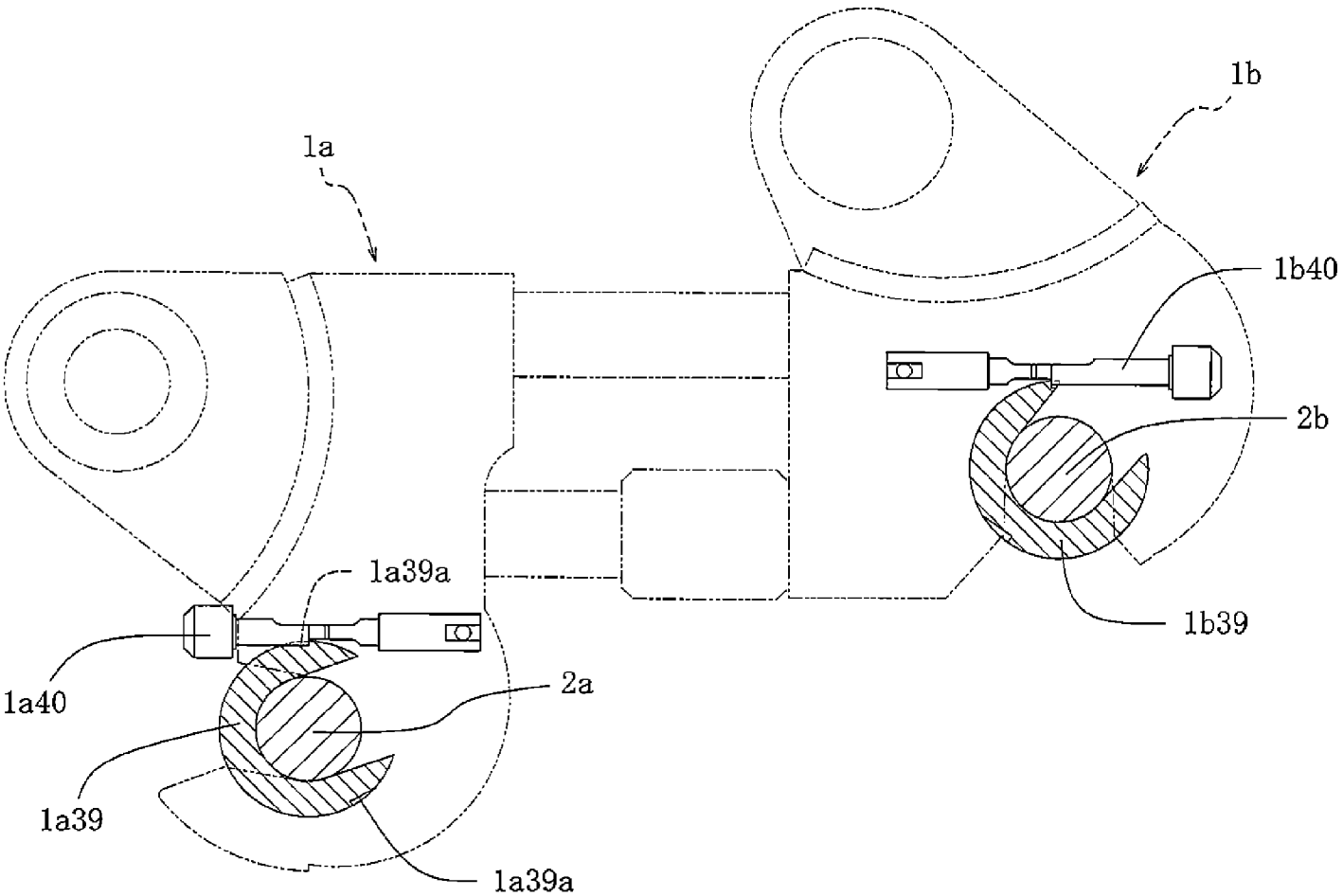
FIG. 11 is a cross-sectional view illustrating the bucket attaching structure of the construction machine in which, in place of the double swinging semicircular arc-shaped closure portions, the revolving semicircular arc-shaped closure portions and the like are used, that is.

FIG. 10 is a cross-sectional view illustrating a bucket attaching structure 1 of a construction machine in which, in place of the double swinging semicircular arc-shaped closure portions, the revolving semicircular arc-shaped closure portions 1*a*39 and 1*b*39 and the like are used, that is, FIG. 10 is a cross-sectional view illustrating a bucket attaching structure 1 in which the revolving semicircular arc-shaped closure portions 1*a*39 and 1*b*39 are in a retracted state, and FIG. 11 is a cross-sectional view illustrating the bucket attaching structure 1 of the construction machine using the revolving semicircular arc-shaped closure portions 1*a*39 and 1*b*39 and the like, that is, FIG. 11 is a cross-sectional view illustrating a state after the bucket connecting pins 2*a* and 2*b* are supported by the revolving semicircular arc-shaped closure portions 1*a*39 and 1*b*39. Furthermore, FIGS. 12A to 12C are each cross-sectional views that illustrate, in detail, the retracted state and the revolved state of the revolving semicircular arc-shaped closure portion 1*a*39 and the supported state of the bucket connecting pin 2*a*.

In such a case, after engaging the semicircular arc-shaped engagement portion 1*a*31 of the fixed jaw portion 1*a* and the semicircular arc-shaped engagement portion 1*b*31 of the movable jaw portion 1*b* with the bucket connecting pins 2*a* and 2*b*, respectively, first, the revolving semicircular arc-shaped closure portions 1*a*39 and 1*b*39 are revolve along the outer peripheries of the bucket connecting pins 2*a* and 2*b*, respectively, to close the open portion sides of the semicircular arc-shaped engagement portion 1*a*31 and the semicircular arc-shaped engagement portion 1*b*31 such that the outer peripheral surface of the bucket connecting pins 2*a* and 2*b* are surrounded by the semicircular arc-shaped engagement portions 1*a*31 and 1*b*31, respectively, and the revolving semicircular arc-shaped closure portions 1*a*39 and 1*b*39, respectively, to support the bucket connecting pins 2*a* and 2*b*.

Then after, the state in which the bucket connecting pins 2*a* and 2*b* are supported by the revolving semicircular arc-shaped closure portions 1*a*39 and 1*b*39 may be continued by, as illustrated in FIGS. 10 and 11, locking the revolving state of the revolving semicircular arc-shaped closure portions 1*a*39 and 1*b*39 by rotation of rotating lock pins 1*a*40 and 1*b*40 that include engagement portions 1*a*40*a* and 1*b*40*a* that engage with engaged portions 1*a*39*a* and 1*b*39*a* of the revolving semicircular arc-shaped closure portions 1*a*39 and 1*b*39 such that the state in which the bucket connecting pins 2*a* and 2*b* are supported by the revolving semicircular arc-shaped closure portions 1*a*39 and 1*b*39 is secured, for example.

Figure 12A:
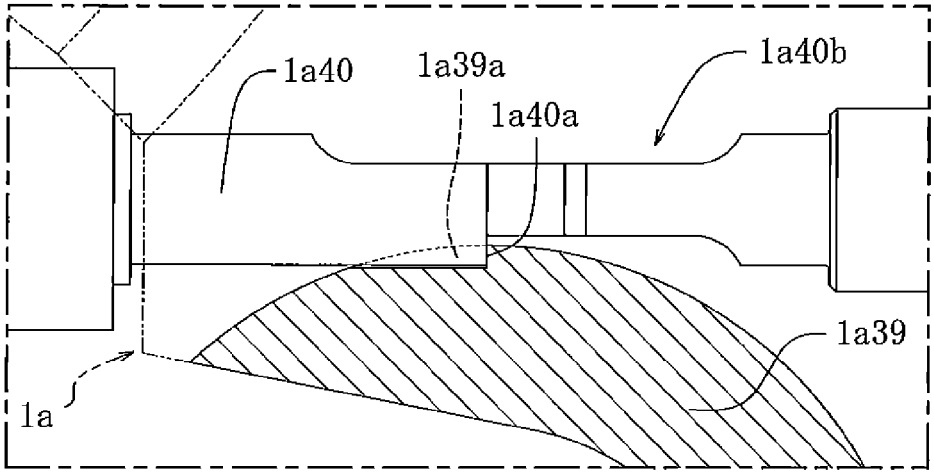
FIGS. 12A to 12C are cross-sectional views each illustrating, in detail, the retracted state and the slid state of the revolving semicircular arc-shaped closure portion and the supported state of the bucket connecting pin.
Figure 12B:
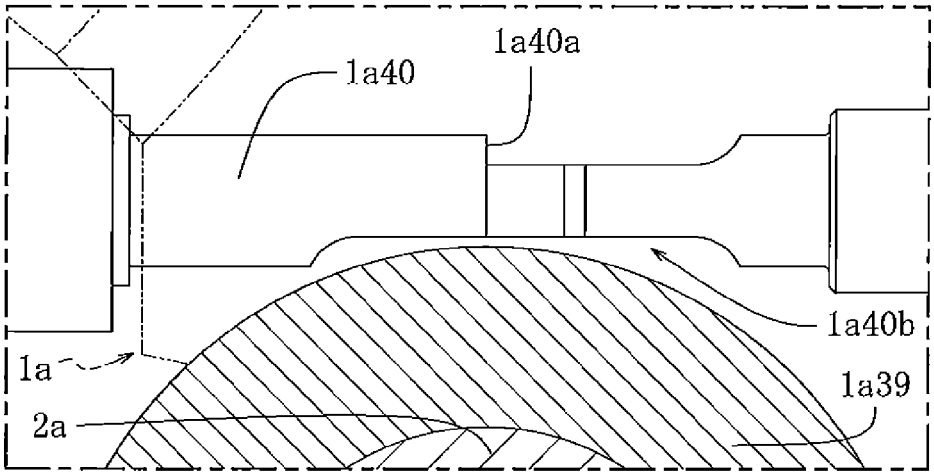
Figure 12C:
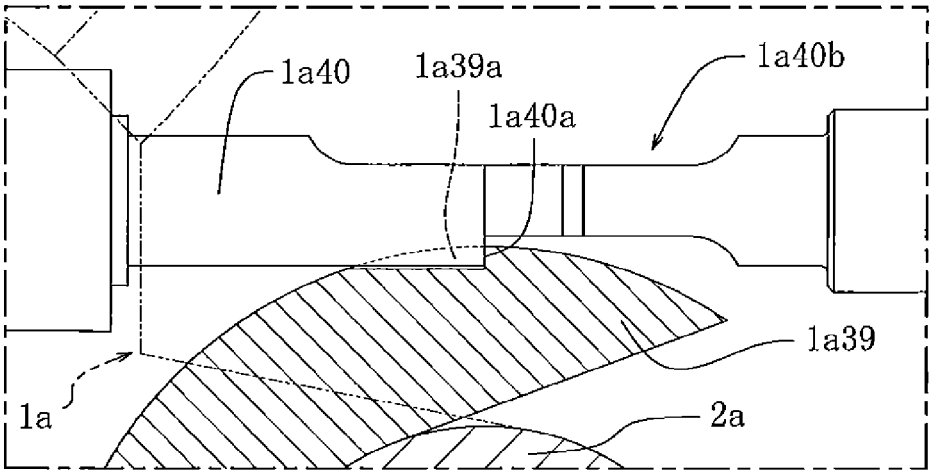

Note that FIGS. 12A and 12C illustrate a state in which revolving state of the revolving semicircular arc-shaped closure portion 1*a*39 is locked by engaging the engagement portion 1*a*40*a* of a rotating lock pin 1*a*40 with the engaged portion 1*a*39*a* of the revolving semicircular arc-shaped closure portion 1*a*39, and FIG. 12B illustrates a state in which the revolving semicircular arc-shaped closure portion 1*a*39 is allowed to revolve freely while the engagement portion 1*a*40*a* of the rotating lock pin 1*a*40 is positioned in a recess 1*a*40*b* of the revolving semicircular arc-shaped closure portion 1*a*39.

Furthermore, the method of locking the revolving state of the revolving semicircular arc-shaped closure portions 1*a*39 and 1*b*39 is not limited to rotating the rotating lock pins 1*a*40 and 1*b*40 and the like, as long as locking can be performed and, it goes without saying that the inserting/extracting lock pins 1*a*33 and 1*b*33 may be used. The same applies to the method of locking the pivoting of the first swinging semicircular arc-shaped closure pieces 1*a*35 and 1*b*35 and the second swinging semicircular arc-shaped closure pieces 1*a*36 and 1*b*36 that are included in the double swinging semicircular arc-shaped closure portions, and not limited to locking using the inserting/extracting lock pins 1*a*33 and 1*b*33, locking may be carried out with other components.

Figure 13:
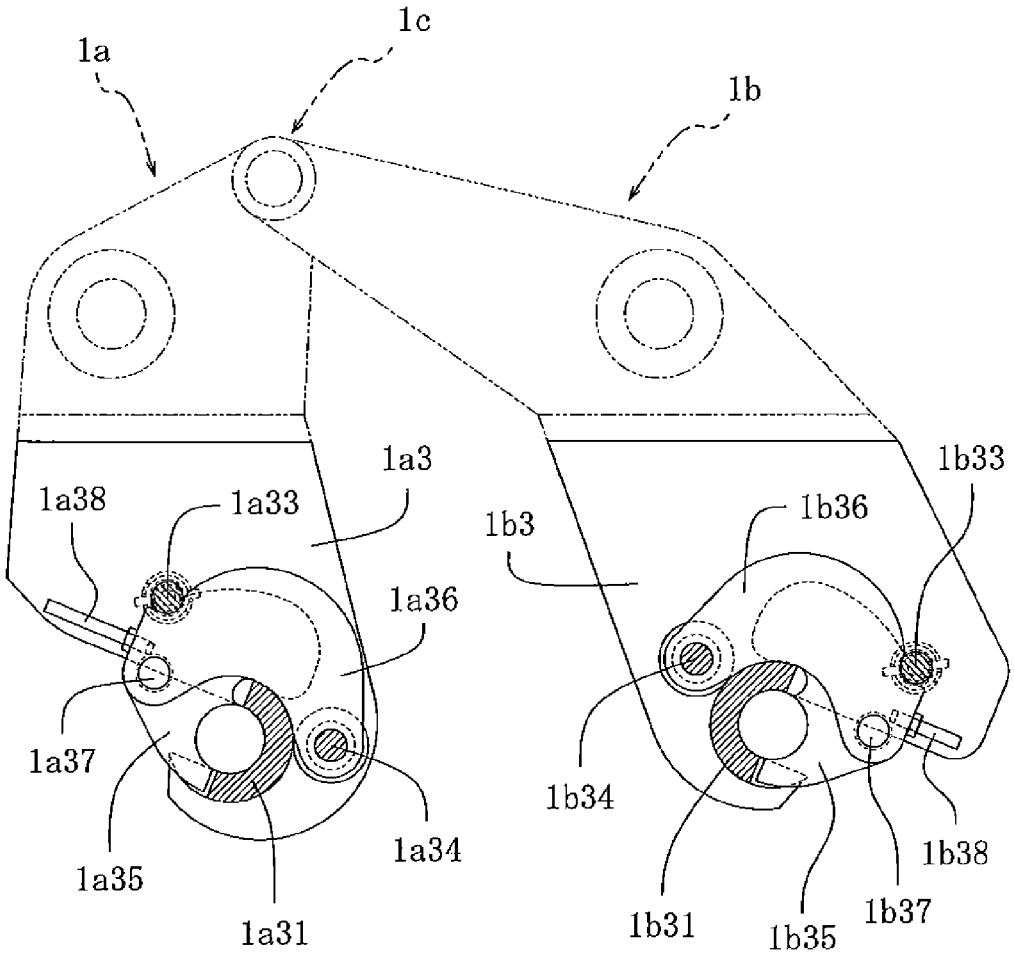
FIG. 13 is an explanatory drawing illustrating an example in which a bucket attaching structure of a construction machine according to an embodiment of the present conception is applied to a construction machine, in which the movable jaw portion is attached in a pivotal manner to the fixed jaw portion with a fulcrum pin.
Figure 14:
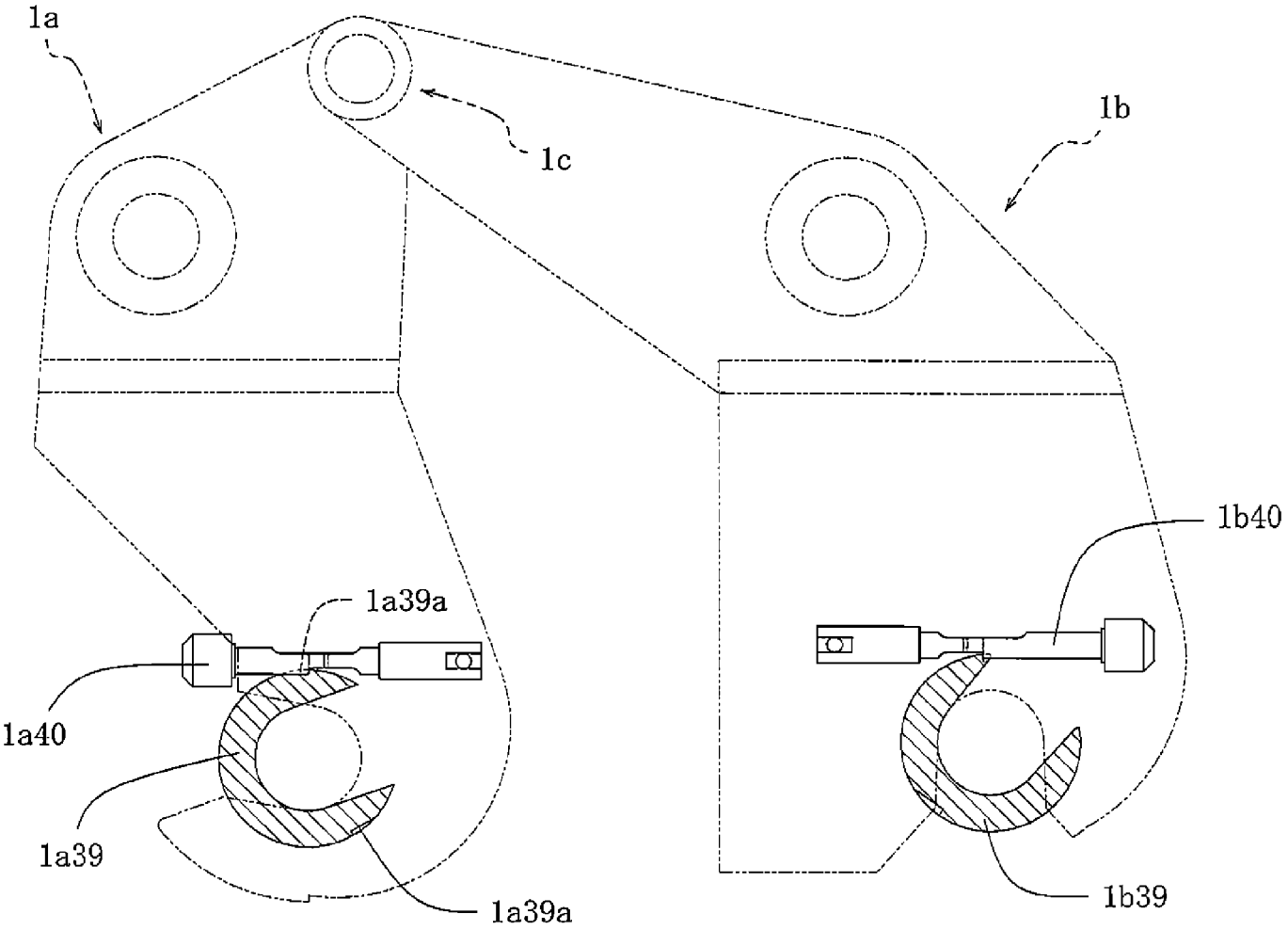
FIG. 14 is an explanatory drawing illustrating another example in which a bucket attaching structure of a construction machine according to an embodiment of the present conception is applied to a construction machine, in which the movable jaw portion is attached in a pivotal manner to the fixed jaw portion with a fulcrum pin.
Figure 15:
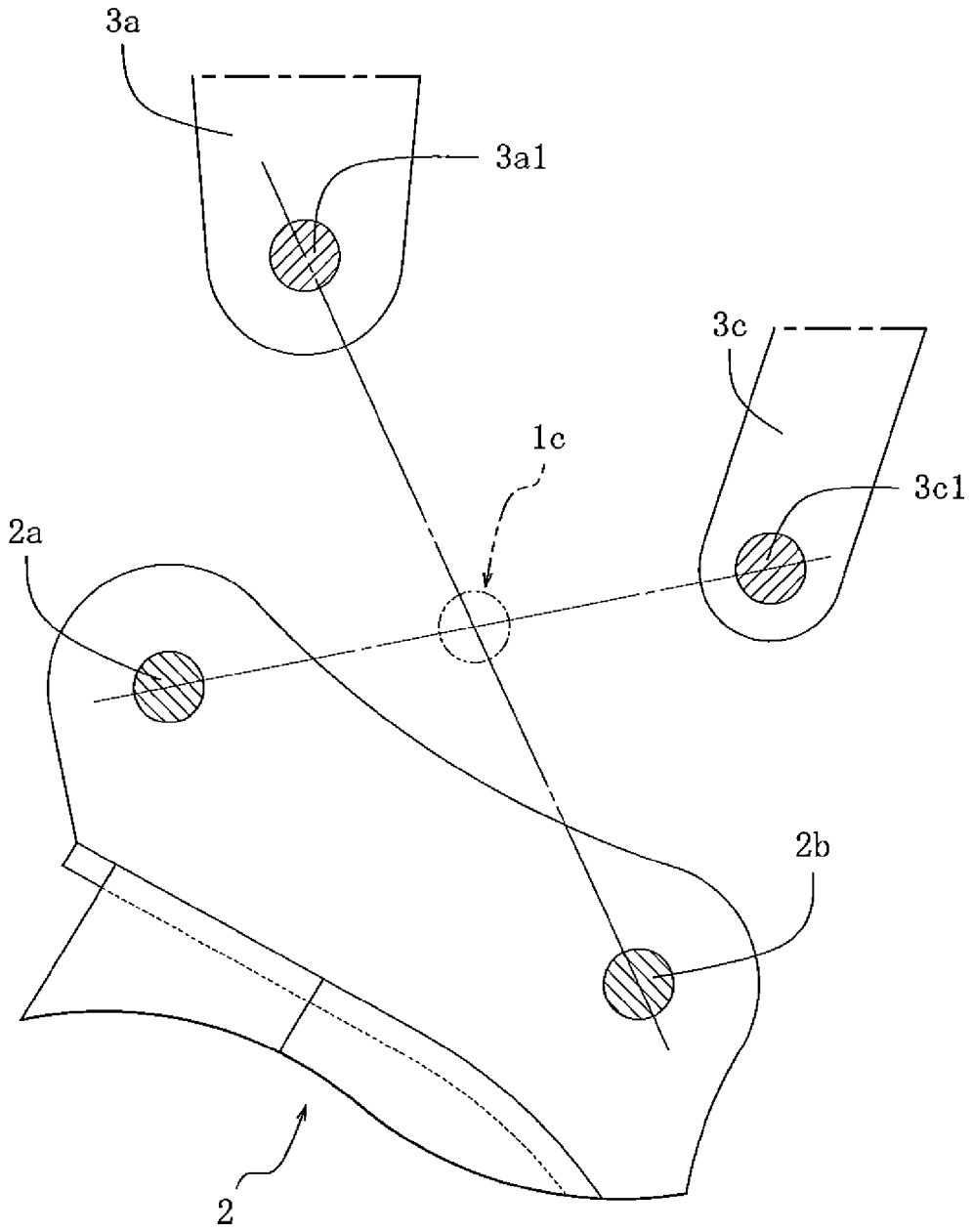
FIG. 15 is an explanatory drawing illustrating another example in which a bucket attaching structure of a construction machine according to an embodiment of the present conception is applied to a construction machine, in which the movable jaw portion is attached in a pivotal manner to the fixed jaw portion with a fulcrum pin.

Furthermore, in the exemplary embodiment described above, as illustrated in FIGS. 1 to 12C, the bucket attaching structure 1 of the construction machine according to the embodiment of the present conception is applied to a construction machine in which the movable jaw portion 1*b* is attached to the fixed jaw portion 1*a* in a slidable manner; however, the present exemplary embodiment is not limited to the above and, naturally, the bucket attaching structure 1 of the construction machine according to the present exemplary embodiment may be applied to any construction machine that attaches the bucket thereto by, for example, relatively displacing or pivoting the movable jaw portion 1*b* with respect to the fixed jaw portion 1*a*. For example, the bucket attaching structure 1 of the construction machine according to the embodiment of the present conception may be, as illustrated in FIGS. 13 and 14, applied to a construction machine in which the movable jaw portion 1*b* is attached to the fixed jaw portion 1*a* in a pivotal manner with a fulcrum pin 1*c* or as illustrated in FIG. 15, may be applied to a construction machine in which the movable jaw portion (not shown) intersects the fixed jaw portion in an X-shape or a cross-shape and is attached to the fixed jaw portion in a pivotal manner with a fulcrum pin 1*c* at the intersection point.

What is claimed is:

1. A bucket attaching structure of a construction machine, comprising:

a fixed jaw portion that is attached to a distal end portion of an operation arm of the construction machine, the construction machine including a power shovel; and a movable jaw portion that is attached to a distal end portion of a piston through a bucket link, the piston being extended from and retracted into a bucket driving cylinder, wherein a bucket is attached to the construction machine by engaging each of the fixed jaw portion and the movable jaw portion to a corresponding one of two bucket connecting pins, the bucket connecting pins being provided at a predetermined interval with respect to each other on a rear side of the bucket, and the fixed jaw portion and the movable jaw portion each include a partially open, semicircular arc-shaped engagement portion having a semicircular arc-shaped cross-section corresponding to an outer peripheral surface of the bucket connecting pin, and a semicircular arc-shaped closure portion having a semicircular arc-shaped cross-section, the semicircular arc-shaped closure portion supporting one of the bucket connecting pins between the semicircular arc-shaped closure portion and the semicircular arc-shaped engagement portion by closing a partially open side of the semicircular arc-shaped engagement portion after the semicircular arc-shaped engagement portion is engaged with the one of the bucket connecting pins, wherein each swinging semicircular arc-shaped closure portion of the fixed jaw portion and the movable jaw portion includes a first swinging semicircular arc-shaped closure piece and a second swinging semicircular arc-shaped closure piece that are connected to each other swingably by a turning pin, a base end side of each first swinging semicircular arc-shaped closure piece of the semicircular arc-shaped closure portions of the fixed jaw portion and the movable jaw portion is coupled to a distal end side of the corresponding second swinging semicircular arc-shaped closure piece swingably by a turning pin and a distal end side of each first swinging semicircular arc-shaped closure piece of the semicircular arc-shaped closure portions of the fixed jaw portion and the movable jaw portion includes a semicircular arc-shaped abutting portion that corresponds to an outer peripheral surface of the corresponding bucket connecting pin, and the semicircular arc-shaped abutting portion and the semicircular arc-shaped engagement portion of the movable jaw portion or the fixed jaw portion hold and support the bucket connecting pin therebetween, and the distal end side of each second swinging semicircular arc-shaped closure piece of the semicircular arc-shaped closure portions of the fixed jaw portion and the movable jaw portion is coupled to the base end side of the corresponding first swinging semicircular arc-shaped closure piece swingably by a turning pin and a base end side of each second swinging semicircular arc-shaped closure piece is attached to the movable jaw portion or the fixed jaw portion swingably by a pivot shaft, and when the semicircular arc-shaped abutting portion of each first swinging semicircular arc-shaped closure piece and the corresponding semicircular arc-shaped engagement portion of the movable jaw portion or the fixed jaw portion hold and support the bucket connecting pin therebetween, an inner surface of each second swinging semicircular arc-shaped closure piece between the corresponding turning pin and the corresponding pivot shaft abuts against the outer peripheral surface of the corresponding semicircular arc-shaped engagement portion.

2. The bucket attaching structure of a construction machine according to claim 1, wherein the movable jaw portion is provided in a slidable manner with respect to the fixed jaw portion, and after the semicircular arc-shaped engagement portion of the fixed jaw portion is engaged with a first bucket connecting pin, the movable jaw portion is slid with respect to the fixed jaw portion so that the semicircular arc-shaped engagement portion of the movable jaw portion engages with a second bucket connecting pin.

3. The bucket attaching structure of a construction machine according to claim 1, wherein a supported state of each bucket connecting pin is locked by an inserting or extracting lock pin after the corresponding swinging semicircular arc-shaped closure portion is pivoted to support the corresponding bucket connecting pin.

4. The bucket attaching structure of a construction machine according to claim 1, wherein:

the movable jaw portion is attached to the fixed jaw portion in a pivotal manner with a fulcrum pin, and after the semicircular arc-shaped engagement portion of the fixed jaw portion is engaged with a first bucket connecting pin, the movable jaw portion is swung about the fulcrum pin with respect to the fixed jaw portion so that the semicircular arc-shaped engagement portion of the movable jaw portion engages with a second bucket connecting pin.

5. A construction machine comprising the bucket attaching structure of a construction machine according to any one of claims 1, 2, 3 and 4.

* * * * *